United States Patent [19]

Oettinghaus

[11] 3,969,657

[45] July 13, 1976

[54] MAGNETIZING AND DEMAGNETIZING ELECTRICAL CIRCUIT

[75] Inventor: Dieter Oettinghaus, Hohenlimburg, Germany

[73] Assignee: Deutsche Edelstahlwerke Aktiengesellschaft, Krefeld, Germany

[22] Filed: Feb. 6, 1975

[21] Appl. No.: 547,395

[30] Foreign Application Priority Data

Oct. 4, 1974 Germany ..... 2447363

[52] U.S. Cl. ..... 317/157.5 PM

[51] Int. Cl.[2] ..... H01F 13/00

[58] Field of Search..... 317/157.5, 151, 157.5 PM; 320/1

[56] References Cited

UNITED STATES PATENTS 3,064,165 11/1962 Kennedy ..... 317/151 X 3,708,726 1/1973 Puvogel ..... 317/151 X

*Primary Examiner*—R. N. Envall, Jr.

*Attorney, Agent, or Firm*—Cushman, Darby & Cushman

[57] ABSTRACT

An appliance for magnetizing and demagnetizing permanent magnets, incorporating an electrical circuit arrangement consisting essentially of at least one chargeable condenser, a magnetizing and demagnetizing coil, an electronic switch, and wherein a diode is arranged in parallel to the said condenser, and two switch means are provided for optionally connecting the said diode to the one or the other end of the said coil.

2 Claims, 4 Drawing Figures

MAGNETIZING AND DEMAGNETIZING ELECTRICAL CIRCUIT

BACKGROUND OF THE INVENTION

This invention relates to an electric circuit for an appliance for magnetizing and demagnetizing permanent magnets.

An arrangement capable of both magnetizing and demagnetizing permanent magnets has not hitherto been proposed. A special coil is needed to magnetize or demagnetize permanent magnets or permanent magnetic systems by the impulsing method. Known circuits which have been used for the purpose of magnetization and demagnetization are shown in FIGS. 1 and 2 of the accompanying drawings which will be described hereinafter.

SUMMARY OF THE INVENTION

The present invention comprises a circuit wherein means are provided for charging a condenser. An electronic switch selectively connects a magnetizing and demagnetizing coil across the condenser. A diode is associated with additional switching means which optionally is connected to one or the other end of the coil for connecting the diode across the condenser.

The invention will be described in further detail by reference to the accompanying drawings wherein.

Figure 3A:
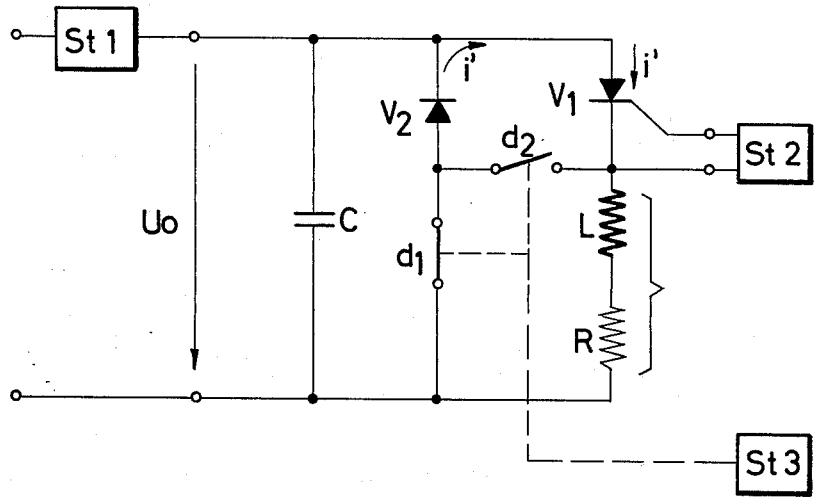
Figure 3B:
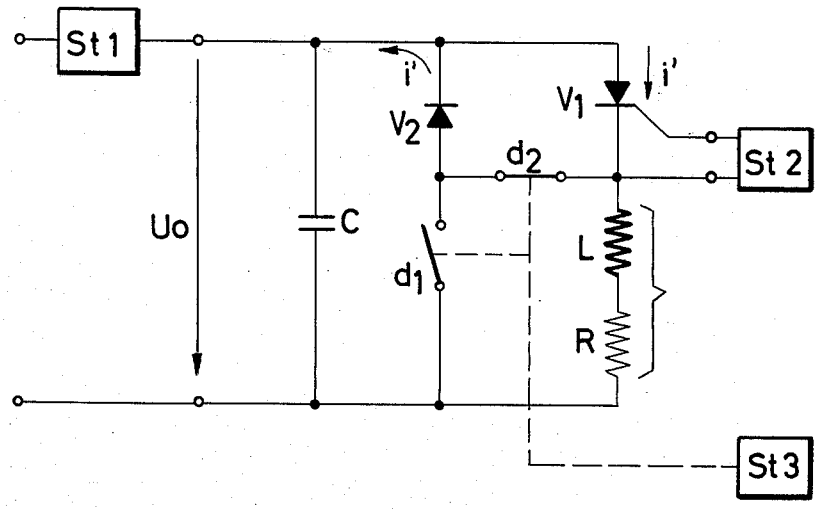

FIG. 3*a* illustrates a circuit arrangement according to the present invention in the magnetizing mode; and FIG. 3*b* illustrates a circuit arrangement according to the present invention in the demagnetizing mode.

DETAILS OF THE INVENTION

Figure 1:
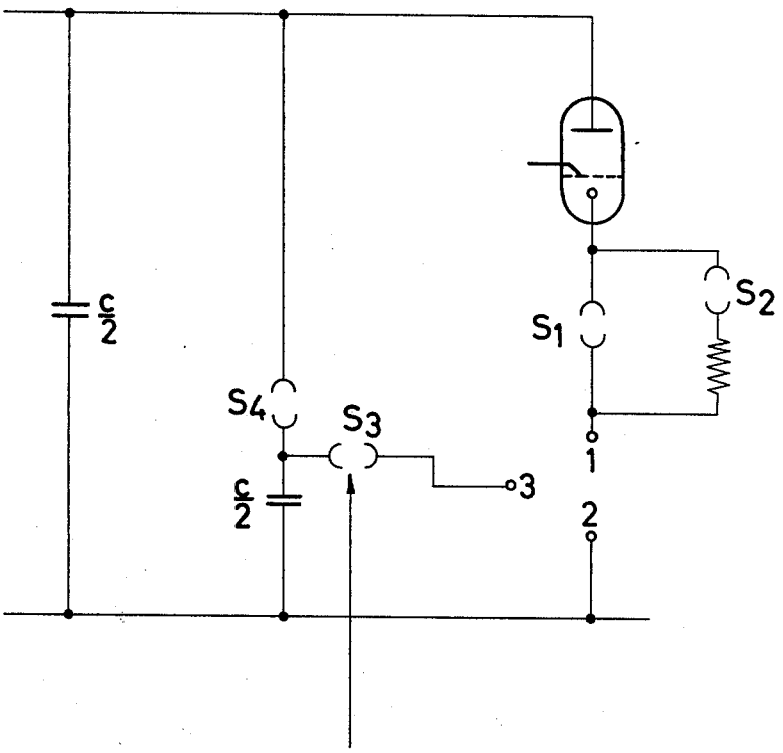
Fig.1 Prior Art
FIG. 1 illustrates a first prior art arrangement for magnetizing or demagnetizing a permanent magnet.

FIG. 1 is a circuit arrangement which permits permanent magnets to be either magnetized or demagnetized. When used for the purpose of magnetization the pin type connectors $S_1$ or $S_2$ and $S_4$ are closed, whereas the connector $S_3$ is open. A magnetizing coil is joined to terminals 1 and 2.

To permit the circuit in FIG. 1 to be used for demagnetizing a permanent magnet the pin connector 3 must be joined and the connector 4 disconnected. Moreover, a different coil having two windings and three connections must now be connected to the three terminals 1, 2 and 3.

It is a defect of this known circuit arrangement that it is necessary to change the coil and also that only half the capacitances of the condensers and hence only half the stored energy can be used for demagnetization.

Figure 2:
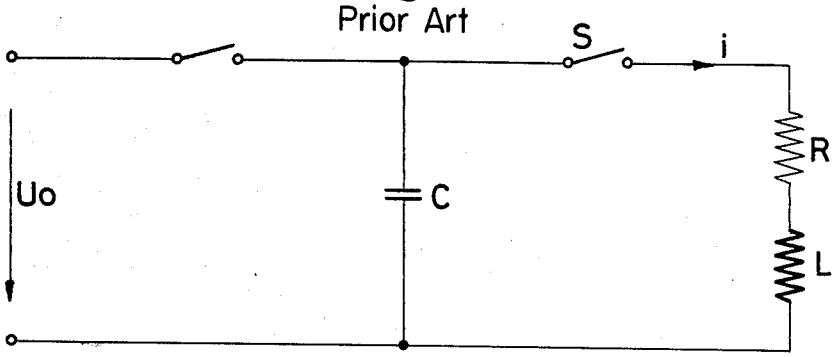
Fig.2 Prior Art
FIG. 2 illustrates a second prior art arrangement suitable for demagnetizing a permanent magnet.

FIG. 2 illustrates the principle of impulse magnetization. Substantially the high current circuit of an impulsing magnetizing apparatus comprises a storage condenser C, a series resister R, an inductance L and a power switch S. The condenser C is charged to a potential $U_0$. When the switch S is closed the current of discharge $i$ flows through the inductor winding and builds up a magnetic field in L. By a suitable choice of the values of the components R, L and C an oscillating energy exchange can be generated. A current of such a kind will analogously generate a decaying alternating field in the magnetizing apparatus which is thus suitable for effecting demagnetizations. However, for magnetizing a permanent magnet the circuit arrangement in FIG. 2 is not suitable.

The present invention is directed to circuit means which can be used for magnetizing as well as for demagnetizing permanent megnets, which can be operated in a simple manner as a magnetizing circuit and alternatively as a demagnetizing circuit, by performing certain switching operations.

The invention provides an electrical circuit arrangement which is characterised in that in a circuit comprising at least one condenser which can be charged, a magnetizing and a demagnetizing coil, as well as an electronic switch. A diode is provided parallel to the condenser, said diode being connectable by two switches optionally either to the one or the other end of the coil. The electronic switch may preferably be a silicon controlled rectifier.

The invention is more particularly described and illustrated in FIGS. 3*a* and 3*b* of the accompanying drawings wherein FIG. 3*a* shows the connections established for effecting magnetizations, and FIG. 3*b* shows the electrical connections in a circuit according to the invention established as required for demagnetizations.

Referring to FIGS. 3*a* and 3*b*, the circuit contains a chargeable condenser C, a magnetization and demagnetization coil L, resistance R, and an electronic switch $V_1$, e.g. a silicon controlled rectifier. A diode $V_2$ is incorporated in the circuit in a branch parallel to the condenser C. This diode can be optionally connected by switch means $d_1$ and $d_2$ respectively to either the one or the other end of the coil L, and resistance R.

If the described arrangement is to be used for magnetizing a permanent magnet switch $d_1$ is closed and switch $d_2$ opened, as shown in FIG. 3*a*. When the condenser C has been charged to a potential $U_0$, and this can be done by controlling electronics $St_1$, the silicon controlled rectifier $V_1$ is opened by the control electrode $St_2$ to allow the discharging current $i'$ to flow through the coil L and resistance R, the condenser C being short-circuited by the diode $V_2$ and switch $d_1$ so that there can be no swing back through the coil L and resistance R.

Conversely, if the circuit is to be used for demagnetizing a permanent magnet, the switch $d_1$ is opened and switch $d_2$ is closed. When the condenser C has been charged and the silicon controlled rectifier $V_1$ is opened the current $i'$ will flow through the coil L and the resistance R and can then oscillate through the condenser and the diode $V_2$ which has been included in the flow path by the closing of switch $d_2$. Consequently a decaying alternating field will be created as required for demagnetization.

The switches $d_1$ and $d_2$ can be easily operated from the outside and from a distance, permitting the circuit to be very easily switched over from magnetization.

The electric circuit arrangement according to the invention has the advantage firstly of being suitable for magnetizing as well as for demagnetising permanent magnets or magnet systems, for instance for moving coil instruments, tachometers and the like. The changeover can be very easily effected by the operation of only two switches. Furthermore the circuit arrangement according to the invention is also of simpler construction and comprises fewer components than arrangements hitherto known which more particularly require two condensers and two coils, whereas the present arrangement needs only one of each of these two components. Hence the arrangement is electrically simpler, cheaper to produce and of more universal applicability than comparable arrangements known in the art.

What is claimed is:

1. A circuit arrangement for magnetizing and demagnetizing permanent magnets comprising:

a condenser;

means for charging the condenser;

a magnetizing and demagnetizing coil;

electronic switch means joined to the coil for selectively connecting said coil across the condenser;

a diode;

additional switch means selectively connected to one end of the coil for connecting said diode across the condenser and to the other end of the coil for connecting the coil and the diode across the condenser.

2. An appliance according to claim 1, wherein the said electronic switch is a silicon controlled rectifier.

* * * * *